US010093466B2

(12) United States Patent
Chan

(10) Patent No.: US 10,093,466 B2
(45) Date of Patent: Oct. 9, 2018

(54) KNOTTING DEVICE

(71) Applicant: Yu-Peng Chan, Changhua (TW)

(72) Inventor: Yu-Peng Chan, Changhua (TW)

( * ) Notice: Subject to any disclaimer, the term of this patent is extended or adjusted under 35 U.S.C. 154(b) by 0 days.

(21) Appl. No.: 15/641,216

(22) Filed: Jul. 4, 2017

(65) Prior Publication Data

US 2017/0297792 A1 Oct. 19, 2017

(51) Int. Cl.
*B65D 63/16* (2006.01)

(52) U.S. Cl.
CPC ..... *B65D 63/16* (2013.01)

(58) Field of Classification Search
CPC ..... B65D 63/16; A44B 11/06; A44B 11/02; A44B 11/04
See application file for complete search history.

(56) References Cited

U.S. PATENT DOCUMENTS 332,925 A * 12/1885 McCarty ..... G09F 3/0352 292/325
1,275,130 A * 8/1918 Carlson ..... B65D 63/14 24/130
2,485,445 A * 10/1949 Hoffman ..... F16G 11/06 24/132 R
3,967,347 A * 7/1976 Bickis, Sr. ..... A44B 11/02 24/193
4,038,726 A * 8/1977 Takabayashi ..... A44B 11/06 24/169
4,117,573 A * 10/1978 Nakamura ..... A44B 11/02 24/200
4,400,855 A * 8/1983 Stuart ..... B65D 63/16 24/200
5,915,629 A * 6/1999 Ribeiro ..... B65D 63/16 24/16 R
6,360,411 B1 * 3/2002 Bortz ..... G09F 3/0311 24/625
7,704,588 B1 * 4/2010 Mrofka ..... B65D 63/16 24/16 R
9,390,635 B2 * 7/2016 Vafadari ..... G09F 3/0323
9,533,807 B2 * 1/2017 Diguglielmo ..... B65D 63/00
9,622,546 B2 * 4/2017 Turdjian ..... A44B 11/06
2008/0209958 A1 * 9/2008 Visotcky ..... E05B 67/00 70/57
2010/0126238 A1 * 5/2010 Mazzucchelli ..... E05B 73/0035 70/58
2011/0154620 A1 * 6/2011 Whitelaw ..... E21B 17/1035 24/122.6
2011/0197397 A1 * 8/2011 Pang ..... A61M 5/1418 24/132 R

* cited by examiner

*Primary Examiner* — Jason W San

(57) ABSTRACT

A knotting device includes a rectangular hollow member including holes, four knurled tunnels on a bottom, and four hooks at four corners respectively; four legs extending from four corners of the rectangular hollow member respectively, each leg being hingedly connected to the rectangular hollow member, and an end latch configured to secure to an adjacent one of the hooks; two first fastening members hingedly secured to two ends of one side of the hollow member respectively, each first fastening member including top projections configured to securely insert into the holes, a first knurled section on a top, and a second knurled section on a bottom; and two second fastening members hingedly secured to one first fastening member, each second fastening member including top projections configured to securely insert into the holes, a first knurled area on a top, and a second knurled area on a bottom.

1 Claim, 8 Drawing Sheets

KNOTTING DEVICE

BACKGROUND OF THE INVENTION

1. Field of the Invention

The invention relates to knots and more particularly to an improved knotting device for straps or cords.

2. Description of Related Art

A box A fastened by two conventional strap B is shown in FIG. 1. The strap B is knotted at a position B1 by means of a tool or machine. However, the fastening is made impossible if the tool or machine is not available.

Thus, the need for improvement still exists.

SUMMARY OF THE INVENTION

It is therefore one object of the invention to provide a knotting device comprising a rectangular hollow member including a cross-shaped space, a plurality of holes, four knurled tunnels each on a central portion of a bottom, two knurled portions on two ends of each knurled tunnel respectively, and four hooks at four corners respectively; four legs extending from four corners of the rectangular hollow member respectively, each leg being hingedly connected to the rectangular hollow member, and a latch at an open end, the latch being configured to secure to an adjacent one of the hooks; two first fastening members hingedly secured to two ends of one side of the hollow member respectively, each first fastening member including a plurality of top projections configured to securely insert into the holes, a first knurled section on a top, and a second knurled section on a bottom; and two second fastening members hingedly secured to one first fastening member, each second fastening member including a plurality of top projections configured to securely insert into the holes, a first knurled area on a top, and a second knurled area on a bottom.

The above and other objects, features and advantages of the invention will become apparent from the following detailed description taken with the accompanying drawings.

DETAILED DESCRIPTION OF THE INVENTION

Figure 1:
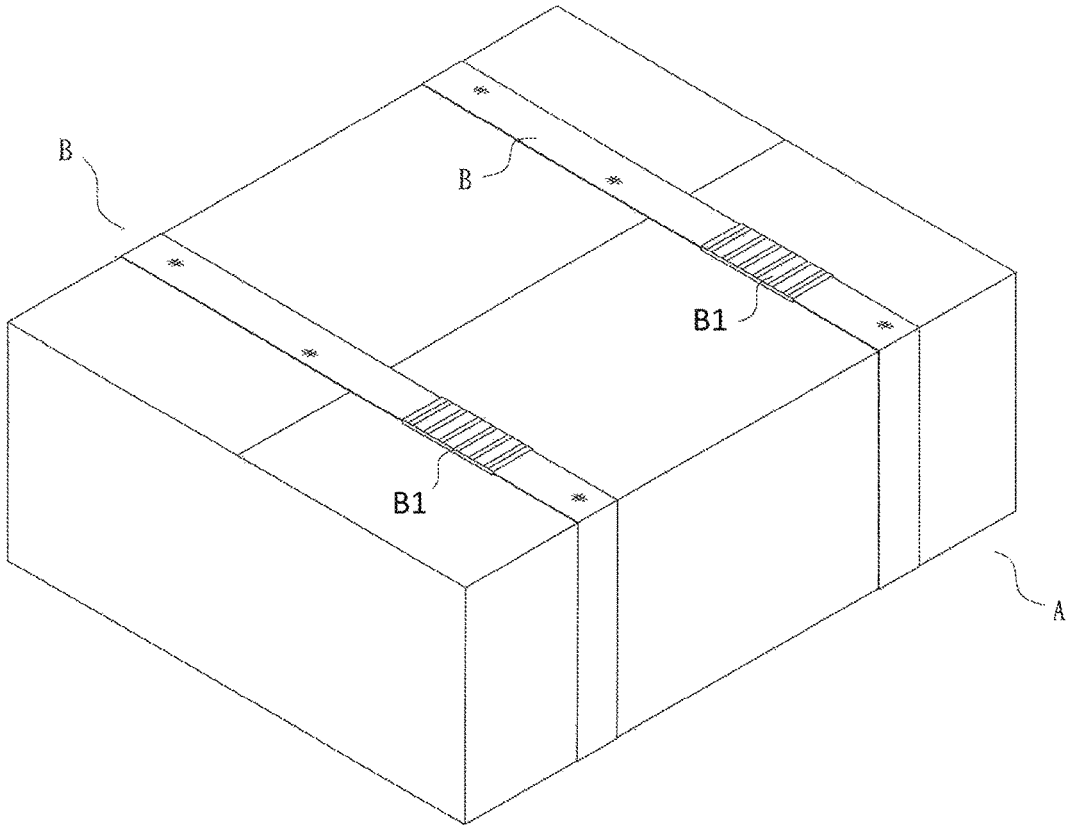
Prior Art FIG.1
FIG. 1 is a perspective view of a box fastened by two conventional knotting devices.
Figure 2:
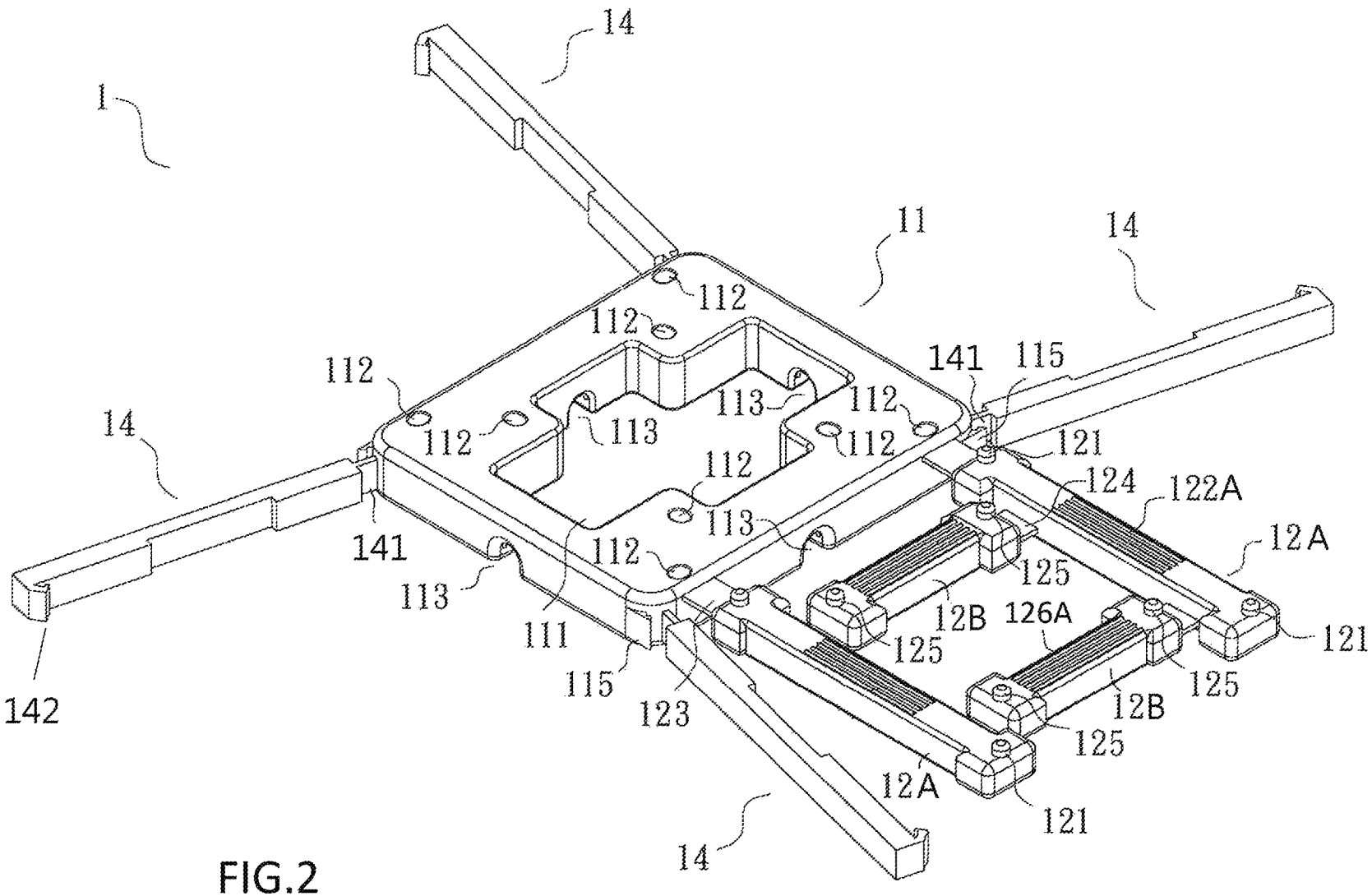
FIG. 2 is an extended, perspective view of a knotting device according to the invention.
Figure 3:
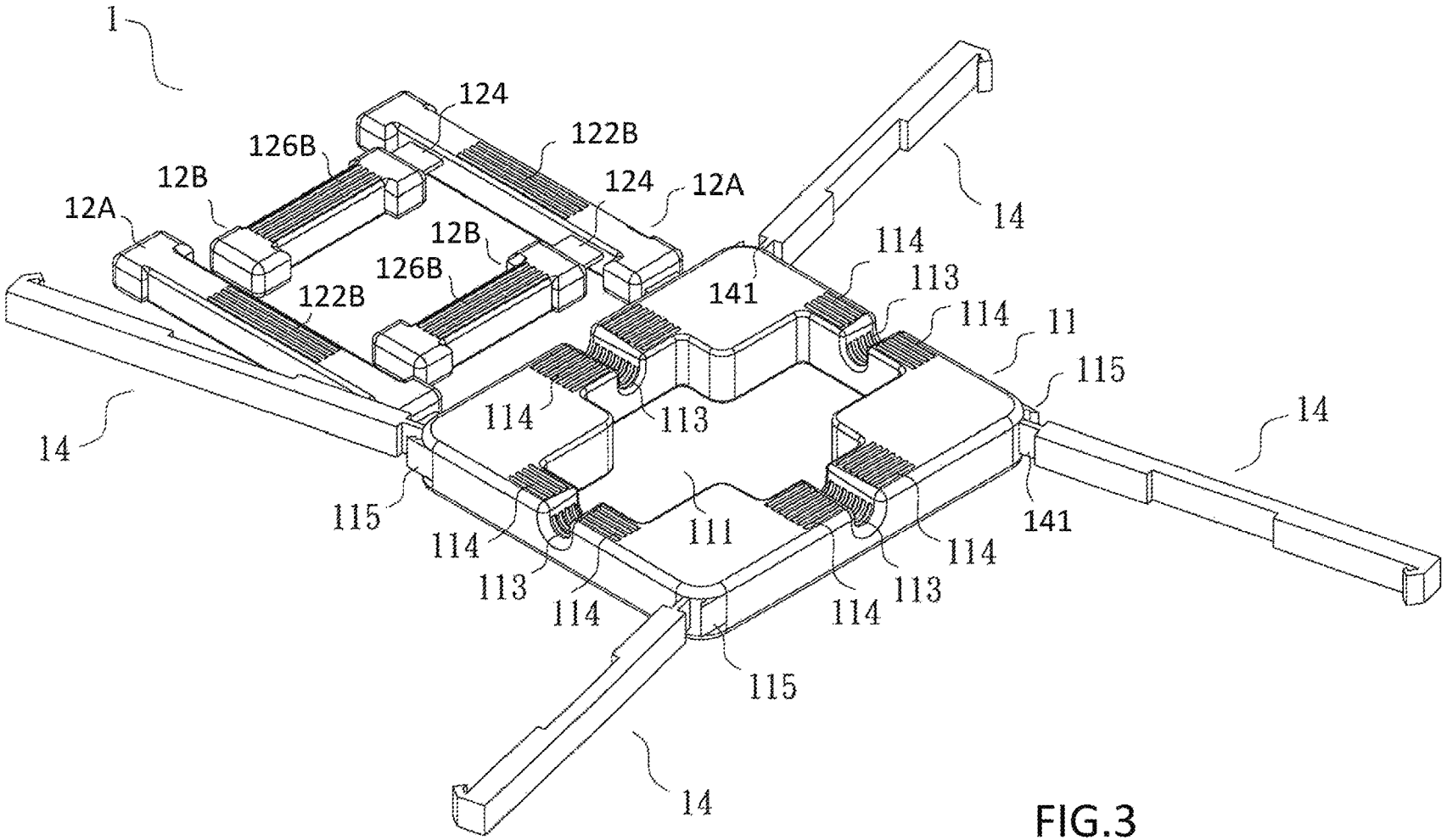
FIG. 3 is another extended, perspective view of the knotting device of FIG. 2.
Figure 4:
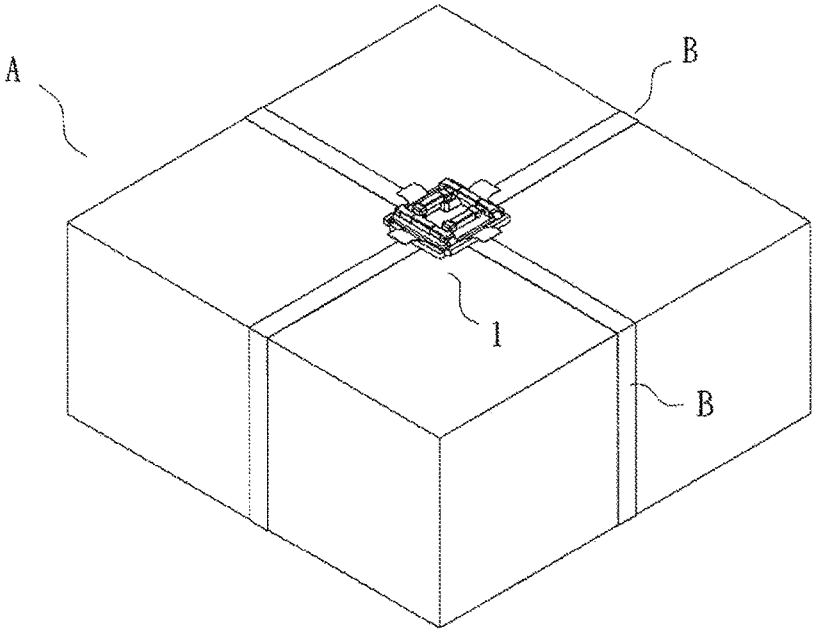
FIG. 4 is a perspective view of a box fastened by two straps and the knotting device of the invention.
Figure 5A:
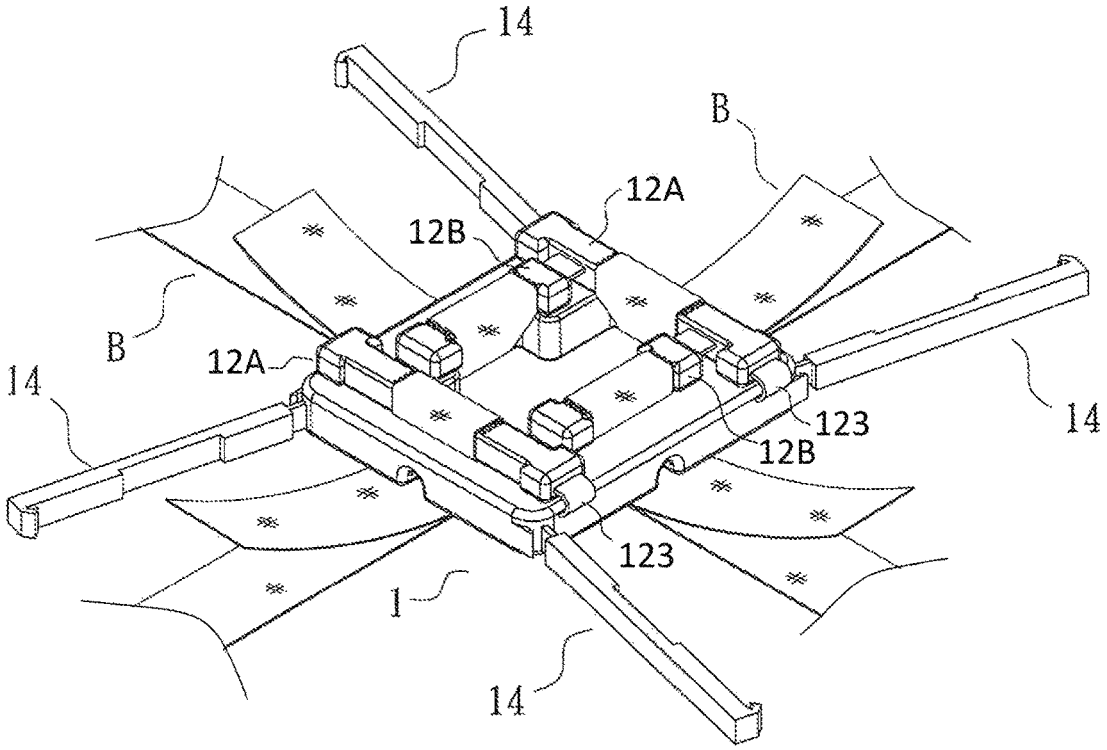
FIGS. 5A and 5B are perspective views of fastening two straps by means of the knotting device of the invention.
Figure 5B:
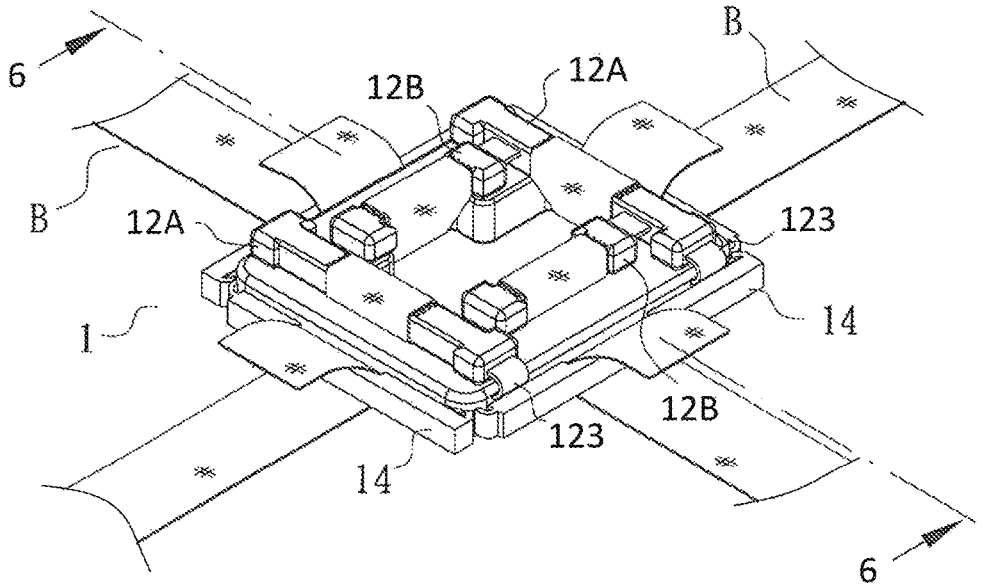
Figure 6:
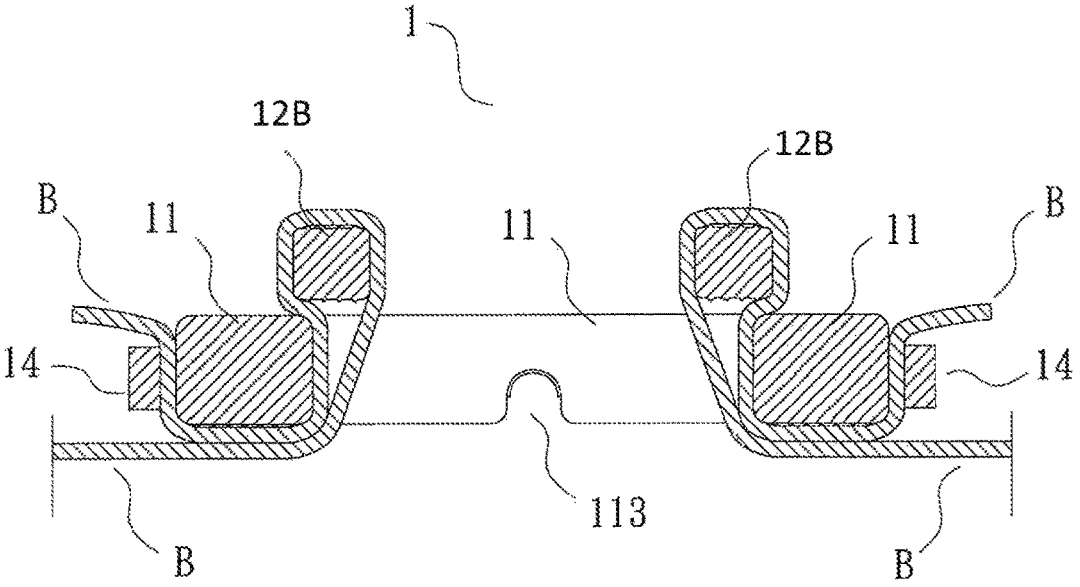
FIG. 6 is a sectional view taken along line 6-6 of FIG. 5B.

Referring to FIGS. 2 to 9, a knotting device 1 in accordance with the invention is shown. The knotting device 1 comprises a rectangular hollow member 11 including a cross-shaped space 111, a plurality of holes 112, four knurled tunnels 113 each on a central portion of one of four sides of a bottom, two knurled portions 114 on two ends of each knurled tunnel 113 respectively, and four hooks 115 at four corners respectively; four legs 14 extending from four corners of the rectangular hollow member 11 respectively, each leg 14 having a hinge 141 connected to the rectangular hollow member 11, and a latch 142 at an open end; two first fastening members 12A each including a hinge 123 attached to either end of one side of the hollow member 11, two projections 121 on two ends of a top respectively, a first knurled section 122A on an intermediate portion of the top, and a second knurled section 122B on an intermediate portion of a bottom; and two second fastening members 12B perpendicular to the first fastening members 12A respectively, each second fastening members 12B including a hinge 124 attached to a position proximate either end of the first fastening member 12A, two projections 125 on two ends of a top respectively, a first knurled area 126A on an intermediate portion of the top, and a second knurled area 126B on an intermediate portion of a bottom. After pivoting the first fastening members 12A onto the top of the rectangular hollow member 11 and inserting the projections 121 and 125 into the holes 112, the rectangular hollow member 11, the first fastening members 12A, and the second fastening members 12B are fastened together.

As shown in FIGS. 4, 5A, 5B and 6, in a first tying fashion, each of two first straps B have one end passing through the bottom of the rectangular hollow member 11 and the space 111, passing around a portion of the second fastening member 12B, passing through a gap between the second fastening members 12B and one side of the rectangular hollow member 11, and passing around the bottom of the rectangular hollow member 11 and an outer surface of one side of the rectangular hollow member 11; and pivoting the leg 14 onto the outer surface of one side of the rectangular hollow member 11 to fastening the latch 142 and the hook 115 together. As a result, the first straps B and the knotting device 1 are fastened together.

In a second tying fashion, two second straps B and the knotting device 1 can be fastened together in a manner similar to the description of above paragraph. As a result, a box A having a square cross-section is tied (see FIG. 4).

Figure 7:
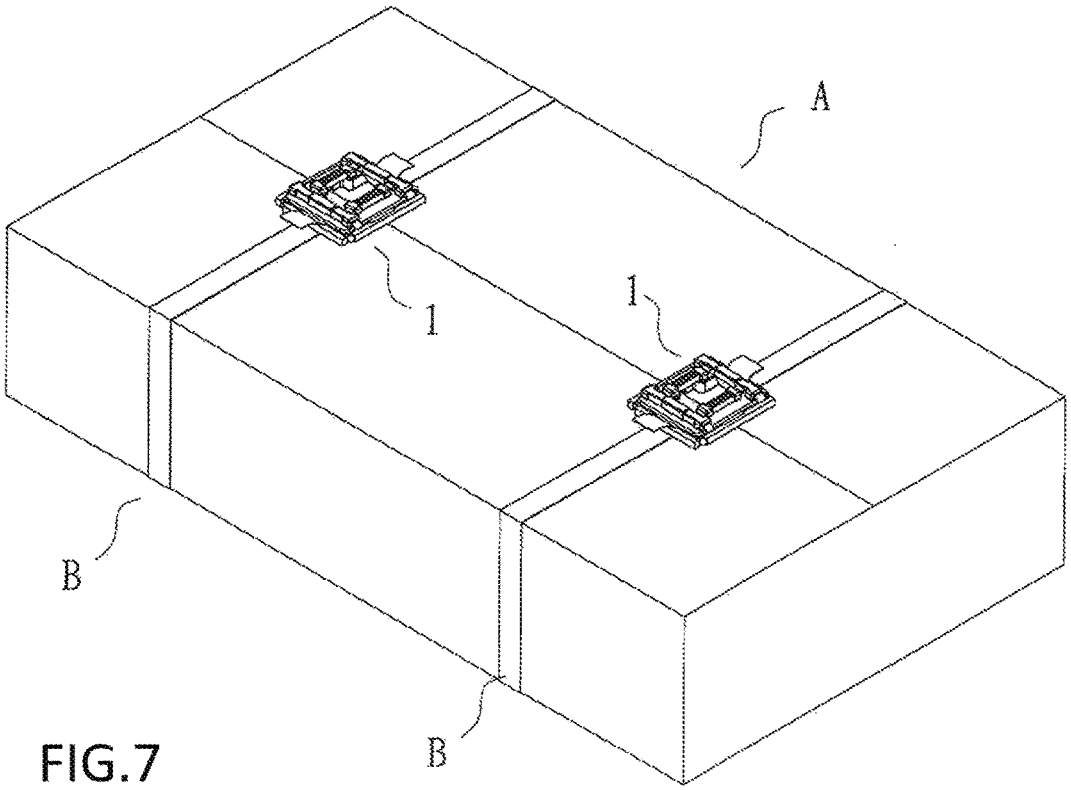
FIG. 7 is a perspective view of a box fastened by two knotting devices and two knotting devices of the invention.
Figure 8A:
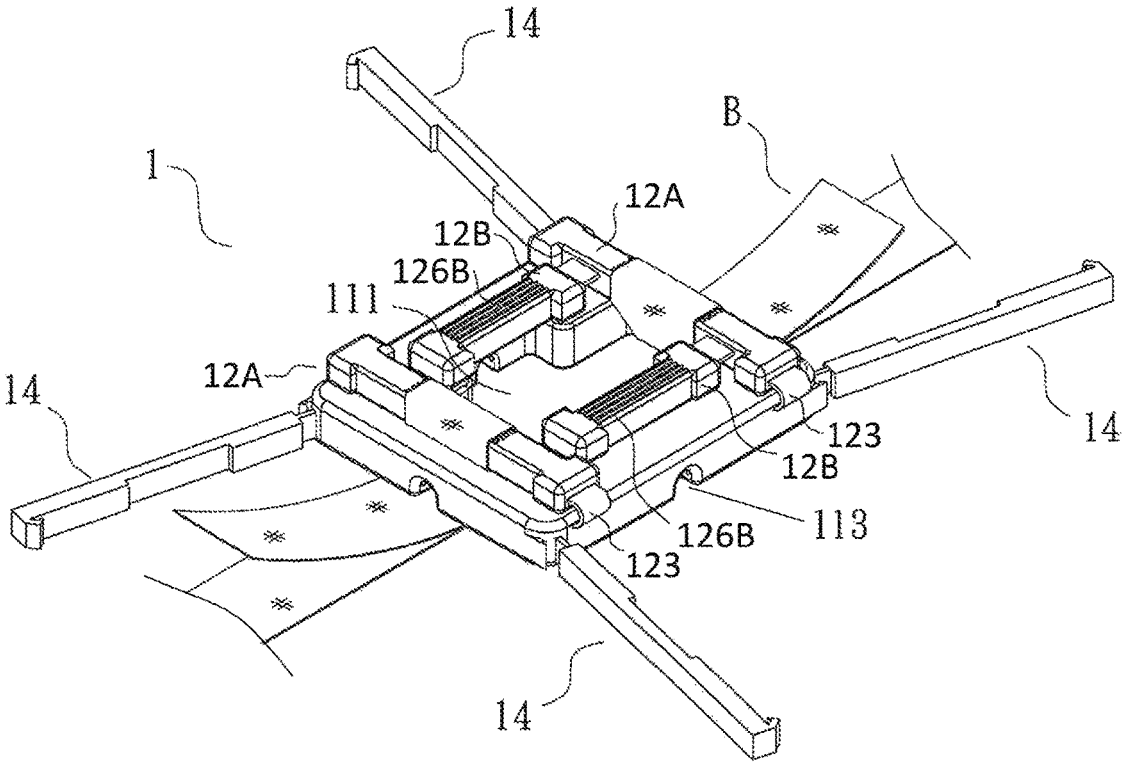
FIGS. 8A and 8B are perspective views of fastening a strap by means of the knotting device of the invention.
Figure 8B:
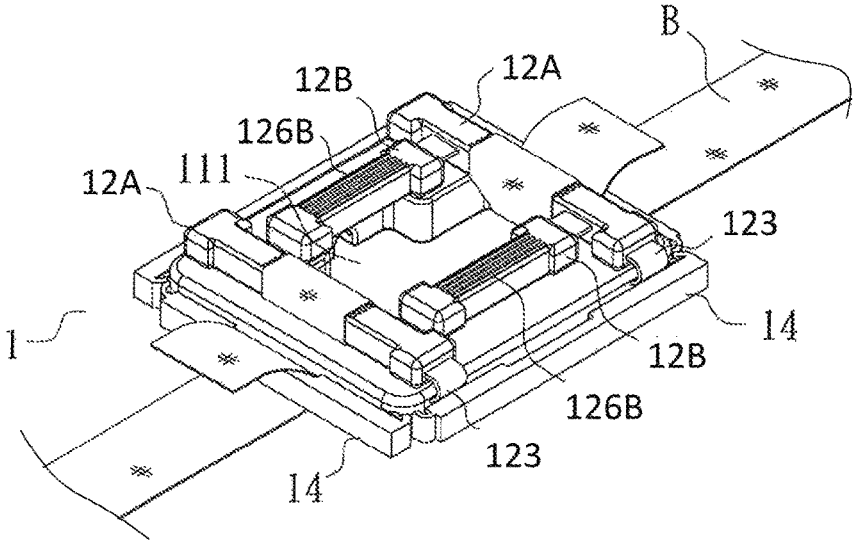

As shown in FIGS. 7, 8A and 8B, in a third tying fashion, each of two first straps B have one end passing through the bottom of the rectangular hollow member 11 and the space 111, passing around a portion of the second fastening member 12B, passing through a gap between the second fastening members 12B and one side of the rectangular hollow member 11, and passing around the bottom of the rectangular hollow member 11 and an outer surface of one side of the rectangular hollow member 11; and pivoting the leg 14 onto the outer surface of one side of the rectangular hollow member 11 to fastening the latch 142 and the hook 115 together. The first straps B and the knotting device 1 are fastened together. As a result, a box A having a rectangular cross-section is tied (see FIG. 7).

Figure 9:
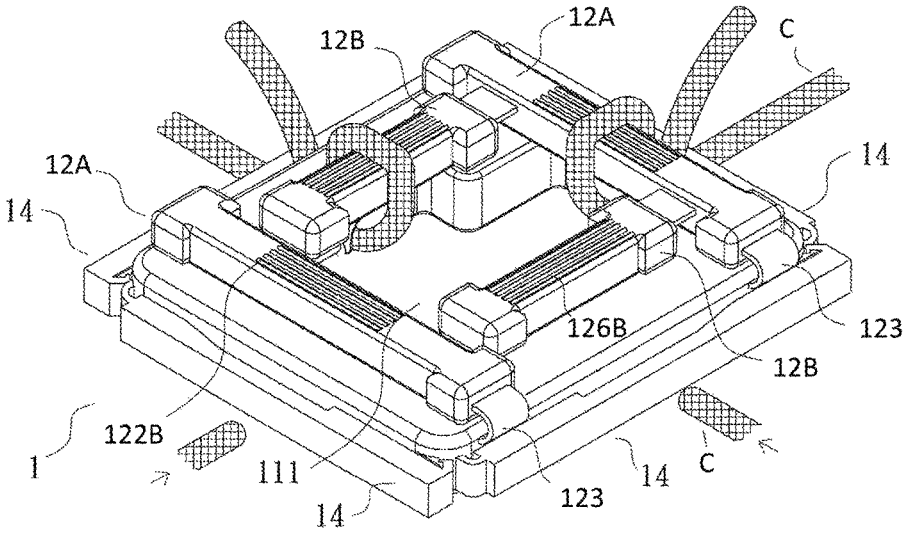
FIG. 9 is a perspective view of cords knotted on the knotting device of the invention.

As shown in FIG. 9, in a fourth tying fashion, each of two first cords C have one end passing through the tunnel 113 of the rectangular hollow member 11 and the space 111, passing around a portion of the second fastening member 12B, passing through a gap between the second fastening members 12B and one side of the rectangular hollow member 11, and passing around the bottom of the rectangular hollow member 11 and an outer surface of one side of the rectangular hollow member 11; and pivoting the leg 14 onto the outer surface of one side of the rectangular hollow member 11 to fastening the latch 142 and the hook 115 together. As a result, the first straps C and the knotting device 1 are fastened together.

In a fifth tying fashion, two second cords C and the knotting device 1 can be fastened together in a manner similar to the description of above paragraph.

While the invention has been described in terms of preferred embodiments, those skilled in the art will recognize that the invention can be practiced with modifications within the spirit and scope of the appended claims.

What is claimed is:

1. A knotting device comprising:

a rectangular hollow member including a cross-shaped space, a plurality of holes, four knurled tunnels each on a central portion of a bottom, two knurled portions on two ends of each knurled tunnel respectively, and four hooks at four corners respectively;

four legs extending from four corners of the rectangular hollow member respectively, each leg being hingedly connected to the rectangular hollow member, and a latch at an open end, the latch being configured to secure to an adjacent one of the hooks;

two first fastening members hingedly secured to two ends of one side of the hollow member respectively, each first fastening member including a plurality of top projections configured to securely insert into the holes, a first knurled section on a top, and a second knurled section on a bottom; and two second fastening members hingedly secured to one of the first fastening members, each second fastening member including a plurality of top projections configured to securely insert into the holes, a first knurled area on a top, and a second knurled area on a bottom.

* * * * *